United States Patent [19]

D'Amico, Jr.

[11] 3,995,550

[45] Dec. 7, 1976

[54] APPARATUS FOR STABILIZING A LIQUID FILLED ARTILLERY PROJECTILE

[75] Inventor: William P. D'Amico, Jr., Elkton, Md.

[73] Assignee: The United States of America as represented by the Secretary of the Army, Washington, D.C.

[22] Filed: Dec. 3, 1975

[21] Appl. No.: 637,358

[52] U.S. Cl. ..... 102/66; 102/6; 102/90; 102/92.1

[51] Int. Cl.[2] ..... F42B 13/14; F42B 13/44

[58] Field of Search ..... 102/6, 66, 90, 57, 91, 102/92, 92.1–92.7, 60

[56] References Cited

UNITED STATES PATENTS

| | | | |
|---|---|---|---|
| 375,190 | 12/1887 | Palmer | 102/57 |
| 1,819,106 | 8/1931 | McBride et al. | 102/66 |
| 3,282,714 | 11/1966 | Wessells | 102/66 |
| 3,427,975 | 2/1969 | Wessells et al. | 102/90 |
| 3,459,129 | 8/1969 | Akhagen | 102/90 |

FOREIGN PATENTS OR APPLICATIONS

| | | | |
|---|---|---|---|
| 272,070 | 8/1912 | Germany | 102/90 |

*Primary Examiner*—Harold Tudor
*Attorney, Agent, or Firm*—Nathan Edelberg; Robert P. Gibson; Saul Elbaum

[57] ABSTRACT

A highly permeable medium, such as an industrial foam, is utilized within the liquid payload cavity of a spinning artillery projectile to prevent flight instabilities produced by resonant oscillations of the liquid payload prior to the time it attains the spin velocity of the projectile. The highly permeable medium is preferably positioned near an end wall of the substantially cylindrical shell casing and physically acts to create highly viscous forces for causing the liquid in contact therewith to spin up to the projectile's velocity with a speed heretofore unrealized.

8 Claims, 1 Drawing Figure

APPARATUS FOR STABILIZING A LIQUID FILLED ARTILLERY PROJECTILE

RIGHTS OF THE GOVERNMENT

The invention described herein may be manufactured, used, and licensed by or for the United States Government for governmental purposes without the payment to me of any royalty thereon.

BACKGROUND OF THE INVENTION

1. Field of the Invention

The present invention is directed toward liquid filled artillery projectiles and, more particularly, as directed towards a stabilization technique and apparatus for spin-stabilizing such artillery projectiles by causing the liquid payload therein to rapidly spin up to the angular velocity of the projectile in which it is encased.

2. Description of the Prior Art

It is generally well known to those skilled in the art that liquid payloads can destabilize the motion of an artillery shell in which it is encased. See, for example, the article entitled: "Engineering Design Handbook-Liquid-Filled Projectile Design," Army Material Command Pamphlet No. 706-165, 1969.

In order to successfully design such liquid-filled projectiles to be as free as possible from such spin-related instabilities, complex mathematical theories have been advanced and numerous "ad-hoc" engineering tests have been conducted. These theories and tests have led to the conclusion that the flight instabilities occur in a large part as a result of an oscillatory non-sloshing motion of the liquid which occurs prior to the time the liquid attains the spin velocity of the shell casing in which it is housed.

One prior art "ad-hoc" approach to liquid payload artillery shell stabilization has been to modify the internal geometry of the payload cavity by, for example, inserting various types of barriers, sleeves, fins, and the like, it being realized that the behavior of the liquid is highly dependent upon the geometry of the payload cavity. One such approach is described, for example, in a report entitled: "Stabilization of a Liquid-Filled Shell by Inserting a Cylindrical Partition in the Liquid Cavity," by J. T. Frasier and W. P. D'Amico, Ballistic Research Laboratories Report No. 1492, August, 1970. In the latter configuration, it was found that the burster modification requirements were too severe for production in requiring, for example, stress free welds and the like, which were very difficult to attain and maintain.

Another ad-hoc approach to stabilizing a liquid-filled shell is illustrated by the 105 millimeter, M410, WP-T (White Phosphorus-Tetryl) cartridge which has a six-bladed impeller attached to a central burster, as described in TM9-1300-203, Artillery Ammunition, April, 1967. This approach, as well as attempts to fill the payload cavity with a low permeability "metal sponge" proved to be unsuccessful during testing, the metal sponge approach being rejected for requiring too much volume within the payload.

OBJECTS AND SUMMARY OF THE INVENTION

Accordingly, a primary object of the present invention is to provide an apparatus for spin-stabilizing a liquid-filled artillery projectile which overcomes all of the disadvantages noted above with respect to prior art techniques, apparatuses, and approaches.

Another object of the present invention is to provide an apparatus for stabilizing a liquid-filled artillery projectile which is inexpensive, compact, easily adaptable within existing liquid-filled projectile designs, and utilizes readily available materials and components.

A still further object of the present invention is to provide a means adaptable within liquid-filled artillery projectiles for stabilizing same during initial spin-up thereof by causing the liquid to spin up to the speed of the shell in which it is encased at a speed far greater than heretofore realized.

A still further object of the present invention is to provide an apparatus for stabilizing a liquid-filled artillery projectile which does not require modification of standard assembly procedures of the projectile in order to be adaptable thereto.

A still further object of the present invention is to provide an apparatus for stabilizing a liquid-filled artillery projectile in which any reduction in payload capacity is minimal.

The foregoing and other objects are attained in accordance with one aspect of the present invention through the provision of an apparatus for stabilizing a liquid-filled artillery projectile which comprises a shell casing, a cavity formed within the shell casing for containing the liquid payload, and means positioned within the cavity for causing the liquid payload to quickly spin up to the spin velocity of the shell casing after the latter is fired from an artillery weapon. The quick spin-up means comprises a highly permeable medium which may be selected from the multitude of commercially available industrial foams. The highly permeable medium is preferably positioned near an end wall of the substantially cylindrical shell casing. The high porousity and elasticity of the highly permeable medium generates viscous forces over a very large surface area which results in the quick spin-up time mechanism.

In accordance with other aspects of the present invention, the shell casing in a preferred embodiment has an opening formed in one end thereof through which is positioned a central burster, the payload cavity being formed about the central burster. The central burster may further comprise a cup-shaped container having an outer diameter on the same order as the diameter of the opening formed in the shell casing, and an elongate tubular member integrally extending from the underside of the cup-shaped container to the other closed end of the cylindrical shell casing. The highly permeable medium in this embodiment comprises a donut-shaped foam member positioned about the elongate tubular member adjacent the point at which it extends from the underside of the cup-shaped container. A retaining member, preferably in the form of a ring-shaped washer, is provided in order to retain the donut-shaped foam member in place.

BRIEF DESCRIPTION OF THE DRAWINGS

The foregoing and other objects, aspects, uses and advantages of the present invention will be more fully apparent as the same becomes better understood when considered in connection with the following detailed description of the present invention viewed in conjunction with the sole drawing FIGURE which depicts a sectional side view of a preferred embodiment of the apparatus for stabilizing a liquid-filled artillery projectile in accordance with the present invention.

DETAILED DESCRIPTION OF THE PREFERRED EMBODIMENT

Figure 1:
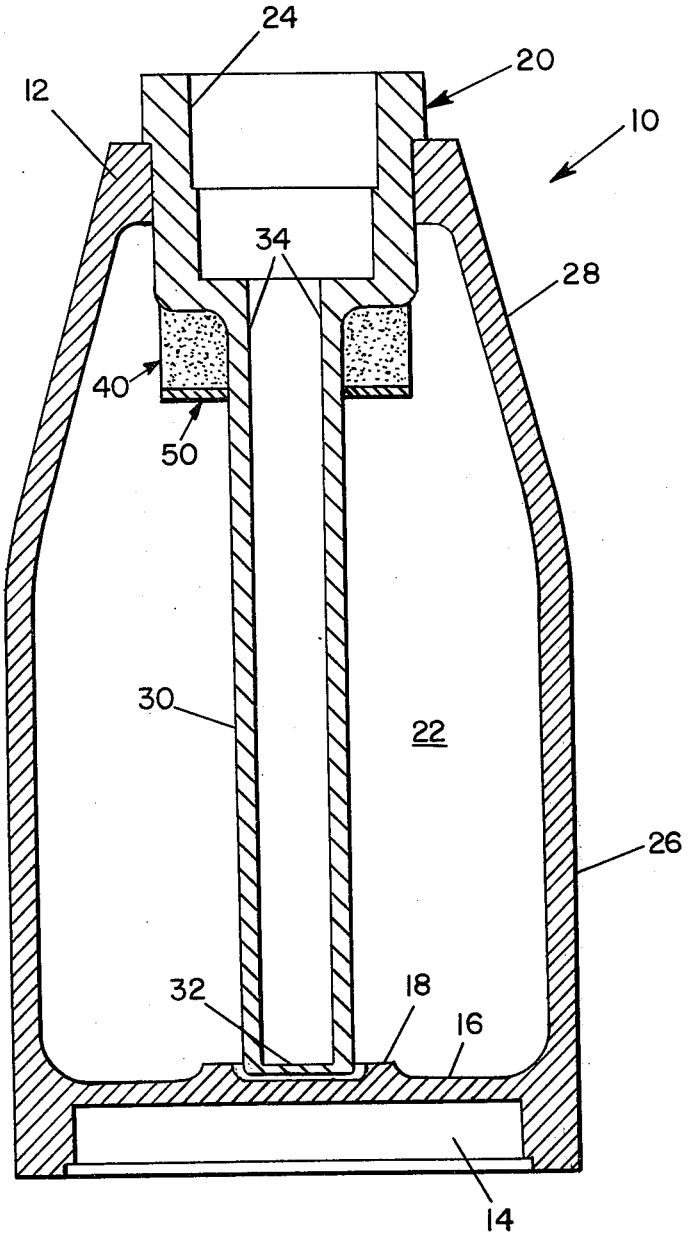

Referring now to the sole drawing FIGURE, a side sectional view is illustrated of a modified liquid payload artillery projectile in accordance with a preferred embodiment of the present invention.

The shell casing is indicated generally by the reference numeral 10 and is seen to be substantially cylindrical in shape. Shell casing 10 comprises a substantially vertical side wall portion 26, an inwardly tapering wall portion 28, a lower or bottom end wall 16, and an upper or top annular neck portion 12.

Bottom end wall 16 has an annular supporting or guide ring 18 formed at the center thereof concentrically about the longitudinal or spin axis X of shell casing 10. Guide annulus 18 is designed to provide support and guidance for the elongate tubular member 30, to be explained in more detail hereinafter.

Positioned within the annular neck 12 of shell casing 10, in the conventional manner, is a payload cavity indicated generally by the reference numeral 20. Payload cavity 20 includes a cup-shaped upper container portion 24 which is sized so as to fit within the diameter of the opening defined by the annular neck 12 of shell casing 10.

Extending integrally from the underside of cup-shaped upper container portion 24 is an elongate tubular assembly 30 which contains the central burster, such as, for example, white phosphorus.

Tubular assembly 30 is characterized by a free closed end 32 which is seated within the annulus 18 formed in bottom end wall 16, and by an upper open end 34 which terminates at the underside of cup-shaped upper container portion 24.

Also conventionally, the cavity 22 defined as the space between the wall portions 26, 28 and elongate tubular member 30 contains the liquid payload. The central burster or explosive contained within the tubular member 30 blows up the projectile to give energy to the payload, all of which is conventional.

In order to more rapidly spin-up the liquid contained within cavity 22 to the angular velocity of the shell casing 10 in which it is housed after launch, a highly permeable medium 40 is positioned near one end of the shell casing 10 as shown in the FIGURE. The highly permeable medium 40 preferably takes the form of a donut-shaped ring 40 positioned about and adjacent to the end 34 of elongate central burster 30 which extends from the underside of cup-shaped upper container 24 of the payload cavity 20. A holding washer 50 may be provided on the underside of highly permeable medium 40 as shown in order to retain same in place during operation.

The highly permeable medium 40 may comprise any of a number of commercially available industrial foams, the main requirement being that the foam have a high permeability (a porosity on the order of 90 percent). Preferably, the elasticity is also high (an ultimate elongation on the order of 400 percent). A highly permeable, highly elastic industrial foam will produce significant decreases in the spin-up time of liquid payloads whose kinematic viscosity is not drastically different from that of water. Such foams are open pore foams and may be coated, if desired, to be compatible to almost any fluid. One particular foam found desirable in connection with the preferred embodiment illustrated in the FIGURE is known as "Industrial Foam" available from the Scott Paper Company, Foam Division of Chester, Pennsylvania. Other examples of suitable foams have porosities ranging from 10 to 60 pores per inch.

Experimental testing of the configuration illustrated in the drawing with the Industrial Foam above-cited has indicated a 15 fold improvement in the spin-up time of liquid-filled artillery projectiles containing the highly permeable medium than the exact same artillery projectile without the highly permeable medium. For example, configurations with the highly permeable medium have had the liquids attain the spin velocity of the shell casing in less than 1 second, while the same liquid payload configuration, but without the highly permeable medium, takes approximately 15 seconds to reach the velocity of the housing in which it is contained.

Although the precise theoretical explanation for the results described above is not believed known at the present time, the basic phenomena is believed to rely on the creation of highly viscous forces resulting from the multitude of small enclosed spaces within the highly permeable medium. Physically speaking, the wetted surface area of such foams are quite large. When the highly permeable medium is spun up, the surface area increases as a result of the increased amount of liquid "sticking" thereto. By means of the high viscosity, fluid sticks to the foam fibers and, as the foam rotates, the fluid "sticking" thereto rotates almost instantaneously. As the various fluid particles first adhere to and then slip off the pores of the foam, another fluid particle or molecule will take its place to also be rapidly spun up to the desired velocity of the object to which the foam is attached.

While various configurations and placement of the highly permeable medium may prove satisfactory, it is desired that in the preferred embodiment the highly permeable medium 40 be placed near one or both end walls of the shell casing 10. It has been found by experiment that insofar as artillery projectiles (idealized as cylindrical bodies) are concerned, it is the end walls thereof that are the only surface areas available to spin up the liquid. Thus, since the volume taken up by the spin stabilizers should be minimized, they should preferably be positioned near one or both end walls of the shell casing 10.

The particular configuration illustrated in the drawing has the annulus shaped foam piece 40 positioned near only one end of shell casing 10. This particular design was chosen in order to avoid having to change standard assembly procedures with the particular cartridge illustrated (152 millimeter, XM410, WP). In other words, the permeable medium 40 may be easily attached to the central burster 20 near the end of the elongate element 30 and will not interfere with the shell casing walls 26 or 28. It should be apparent that the reduction in the capacity of the payload is minimized, especially compared with prior art stabilizing fins and other structures. Finally, the physical characteristics of the particular projectile assembly will not be altered as a result of the addition of the permeable medium 40. Thus, it will be possible in most cases to simply convert high explosive hardware to liquid-fillers. Obviously, another donut-like foam member could be added near the other end 32 of central burster 20 if desired.

I wish it to be understood that I do not desire to be limited to the exact details of construction shown and described, for obvious modifications may be made by persons skilled in the art.

I claim as my invention:

1. Apparatus for stabilizing a liquid-filler artillery projectile, which comprises:

a shell casing;

cavity means formed within said shell casing for containing a liquid payload;

porous foam means positioned within said cavity means for causing said liquid payload to quickly spin-up to the spin velocity of said shell casing after being fired from an artillery weapon.

2. The apparatus for stabilizing a liquid-filled artillery projectile as set forth in claim 1 wherein said shell casing is substantially cylindrical and wherein said porous foam means is positioned near an end wall of said cylindrical shell casing.

3. The apparatus for stabilizing a liquid-filled artillery projectile as set forth in claim 1 wherein the porosity of said foam is on the order of 90 percent.

4. The apparatus for stabilizing a liquid-filled artillery projectile as set forth in claim 3 wherein said foam has a high elasticity in the form of an ultimate elongation on the order of 400 percent.

5. The apparatus for stabilizing a liquid-filled artillery projectile as set forth in claim 2 wherein said shell casing has an opening formed in one end thereof, and wherein means are positioned through said opening for containing a central burster, said cavity means being formed around said central burster containing means.

6. The apparatus for stabilizing a liquid-filled artillery projectile as set forth in claim 5 wherein said central burster containing means comprises a cup-shaped container having an outer diameter on the same order as the diameter of said opening formed in said shell casing, and an elongate tubular member integrally extending from the underside of said cup-shaped container to the other closed end of said cylindrical shell casing.

7. The apparatus for stabilizing a liquid-filled artillery projectile as set forth in claim 6 wherein said porous foam means comprises a donut-shaped foam member positioned about said elongate tubular member adjacent the point at which the latter extends from the underside of said cup-shaped container.

8. The apparatus for stabilizing a liquid-filled artillery projectile as set forth in claim 7 wherein said donut-shaped foam member has a diameter on the order of the diameter of said cup-shaped container, and wherein there is further provided means for retaining said donut-shaped foam member in position about said elongate tubular member.

* * * * *